United States Patent [19]

Cox

[11] 4,235,217

[45] Nov. 25, 1980

[54] ROTARY EXPANSION AND COMPRESSION DEVICE

[76] Inventor: Robert W. Cox, 33 Chapel Hill Rd., Kenmore, Queensland, 4069, Australia

[21] Appl. No.: 913,498

[22] Filed: Jun. 7, 1978

[51] Int. Cl.[3] ..... F02B 55/14; F01C 1/10; F04C 18/10

[52] U.S. Cl. ..... 123/232; 123/246; 418/167; 418/168; 418/171

[58] Field of Search ..... 418/166, 167, 168, 171, 418/61 B; 123/215, 242, 246, 232

[56] References Cited

U.S. PATENT DOCUMENTS

| | | | |
|---|---|---|---|
| 457,294 | 8/1891 | Tilden | 418/168 X |
| 2,740,386 | 4/1956 | Crandall | 418/168 X |
| 2,947,290 | 8/1960 | Froede | 123/215 X |
| 3,199,496 | 8/1965 | Kell | 123/242 X |
| 3,214,087 | 10/1965 | Luck | 418/171 X |
| 3,393,666 | 7/1968 | Yamamoto et al. | 123/242 |

*Primary Examiner*—Leonard E. Smith

[57] ABSTRACT

A rotary gas expansion and compression device having a pair of rotors provided respectively with external and internal flutes differing in number by one, the form of which provides a continuous vertical contact. The rotors are meshed so that they form closed chambers which during rotation continuously vary in volume providing expansion and compression chambers.

2 Claims, 6 Drawing Figures

ROTARY EXPANSION AND COMPRESSION DEVICE

THIS INVENTION relates to improved rotary gas expansion and compression devices such as pumps and engines or the like of the type in which a pair of rotors provided respectively with external and internal flutes differing in number by one, and of the form giving continuous vertical contact, are meshed together such that they form closed varying chambers which during rotation of the rotors continuously vary in volume to provide expansion and compression chambers. Such devices will hereinafter be referred to as gas expansion and compression devices of the type described.

Many rotary internal combustion engines have been proposed to date. However, only few of these have achieved success and even these have their shortcomings. Originally, rotary engines were devised to provide a simplified means for converting fuel into rotary motion as compared with the conventional reciprocating piston engine and to eliminate the vibration problems inherent in a reciprocating engine, and to reduce the plurality of moving and wearing parts in a multi-cylinder four-cycle engine in which complex valve operating mechanisms are utilised.

In reciprocating piston engines, the four-cycle type has proved generally superior to the two-cycle engine, especially in the larger sizes, because each cylinder receives after each power stroke a cooling cycle which acts to maintain the engine at a reasonable operating temperature. Furthermore, expansion is controllable and continues for the entire stroke and thus the ignited gas is able to do more useful work than a two-cycle engine in which the pressure of the expanded gas is used to exhaust the gas from the cylinder and is thus not generally available to do work. Also in the four-cycle engine the exhaust gases are exhausted positively in a separate stroke thus permitting the intake of fresh fuel-air mixture into the cylinder for the next power stroke. Because of their design most rotary engines operate on the two-cycle principle and thus suffer from the disadvantages inherent in two-cycle types.

Another disadvantage of most rotary engines is that the relative speed between the rotating parts is very high and thus effectively sealing between the chambers of the engine is made difficult and heat transfer between the moving parts is reduced. Also wear is greatly increased.

Accordingly, it is an object of this invention to provide a rotary gas expansion and compression device of the type described which will overcome the abovementioned disadvantages and which will operate on the four-cycle principle. It is also an object of this invention to provide a rotary gas expansion and compression device in which relative speed between the rotating parts is kept low, even though the output speed of the motor is high.

With the foregoing and other objects in view this invention resides broadly in a gas expansion and compression device of the rotary piston type described, characterised in that there are provided longitudinal ridges in one rotor, hereinafter referred to as the said ridged rotor, and substantially conforming flutes in the other rotor, hereinafter referred to as said fluted rotor, said flutes extending between longitudinal apices portions spaced evenly around fluted rotor and adapted for engagement between the longitudinally extending valleys formed in said ridged rotor at the junction of said ridges, and the diameter of the base circle coincident with the base of said valleys and the diameter of the tip circle coincident with said apices being in the ratio of the respective number of ridges and flutes which differ in number by one, and the axes of rotation of the respective rotors being offset a distance substantially equal to the differences of the radii of the base circle diameter and the tip circle diameter whereby rotation of one said rotor will cause rotation of the other said rotor, and the depth of each respective ridge from said base circle being substantially equal to the difference between the diameter of said base circle and the diameter of said tip circle, and said ridges being arcuate in cross-section such that each said apex remains in contact with a said ridge during rotation of said rotors.

In order that the invention may be more readily understood and put into practical effect reference will now be made to the accompanying drawings which illustrate some of the preferred embodiments of the invention and wherein.

It will be noted that all the drawings illustrate devices in which the rotors and housings have constant cross-sectional configurations throughout their lengths.

Figure 1:
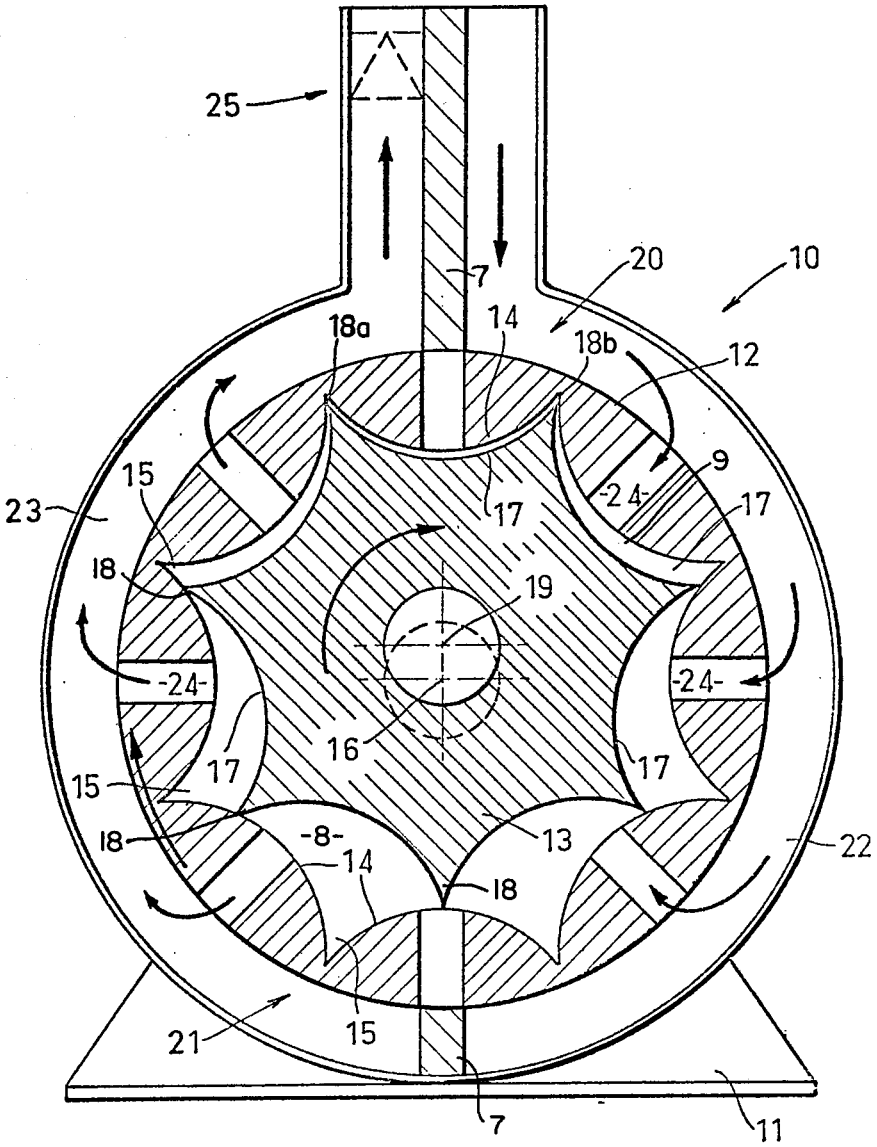
FIG. 1 is a diagrammatic cross-sectional view of a device of the present invention arranged as a compressor.

Referring firstly to FIG. 1 there is shown an embodiment of the invention arranged as a compressor 10 comprising a fixed support frame 11 supporting an outer rotor 12 and an inner rotor 13. The outer rotor 12 is rotatably mounted on the frame 11 for clockwise rotation and includes eight internally disposed identical ridges 14 formed between eight equally spaced valleys 15 which are arranged symmetrically about the axis of rotation 16 of the outer rotor 12. The inner rotor 13 has seven externally disposed flutes 17 formed between outwardly extending apices 18 which are spaced symmetrically around the axis 19 of the inner rotor 13 which is offset from the axis 16 with respect to the housing 13 and not the frame 11.

As shown in FIG. 1, at top dead centre position indicated by the numeral 20, the two uppermost and adjacent valleys 15 in the housing 12 accommodate the upper two apices 18 of the rotor 13, so that at these uppermost points of coincidence 18*a* and 18*b*, respectively, there is no relative movement between the rotors 12 and 13 and thus at the points 18*a* and 18*b* their tangential speeds are identical. The ratio of the number of apices 18 to the number of valleys 15 is, in this instance, seven is to eight, and the ratio of the base circle diameter of the outer rotor 12 and coinciding with the base of the valleys 15, to the tip circle diameter of the inner rotor 13 and coinciding with the apices 18 of the inner rotor 13 is seven is to eight. As the tangential velocities of the outer rotor 12 and the inner rotor 13 at their respective base and tip circles are the same as set out above, their angular speed of rotation are different, as their diameters are different. Accordingly, the inner rotor 13 rotates at one and one-seventh the speed of the outer rotor 12. Thus for one complete revolution of the outer rotor 12 the inner rotor will advance therein one segment. As shown, the ridges 14 between the valleys 15 are so shaped that the tips of the projections 18 maintain continuous contact therewith.

This arrangement gives a pair of intermeshing rotors in which a complete revolution of the inner rotor 13 will result in each apex 18 advancing to its identical position on the next forward ridge portion 14 of the outer rotor 12 and in so doing, an expanding chamber 9 is formed at the right-hand side of the pump 10 as illustrated between each respective ridge 14 and the next forward ridge portion 14, and each adjacent pair of apices 18. At the left-hand side of the pump 10 a compression chamber 8 is similarly formed. As the axes 16 and 19 are fixed and the respective rotors 12 and 13 rotate about fixed axes 16 and 19, the shapes of the expansion and compression chambers 9 and 8 respectively vary in stages in the manner illustrated. Thus, while each chamber 8 and 9 is separate and distinct, the illustration shows the shape in stages of each chamber as it is formed between the respective apices 18 and ridges 14 as the inner rotor 13 performs a complete revolution. At the same time the centre rotor will have advanced seven-eighths of a revolution.

In this embodiment, the outer rotor 12 has a cylindrical outer surface and there is provided an enveloping manifold around the outer surface which is divided by the partition wall 7 into an inlet manifold 22 at the right-hand side of the pump 10 and the plane passing through the axes 16 and 19, and an outlet manifold 23 on the left-hand side. The walls 7 form a wiping seal about the outer face of the rotor. There are provided ports 24 placing the inner surface of the outer rotor 12 at the crest of each ridge 14 in liquid communication with the exterior of the outer rotor, and thus the inlet and exhaust manifolds 22 and 23. Rotation of the inner rotor 13 and the outer rotor 12 and the resultant formation of expansion chambers 9 and compression chambers 8 will cause gas to flow through the ports 24 into the expanding chambers until the trailing projection 18 of each chamber passes across the respective transfer port 24, approximately at bottom dead centre at 21, but of course variable in known manner, whereafter compression chambers are formed causing the gas contained in the chambers to be forced through the ports 24 to the outlet manifold 23. A non-return valve 25 may be provided in known manner in the exhaust manifold.

Thus it will be seen that the invention can be utilized as a simple compressor, and this simple embodiment has been described by way of introduction to facilitate the basic operation of the invention.

Figure 2:
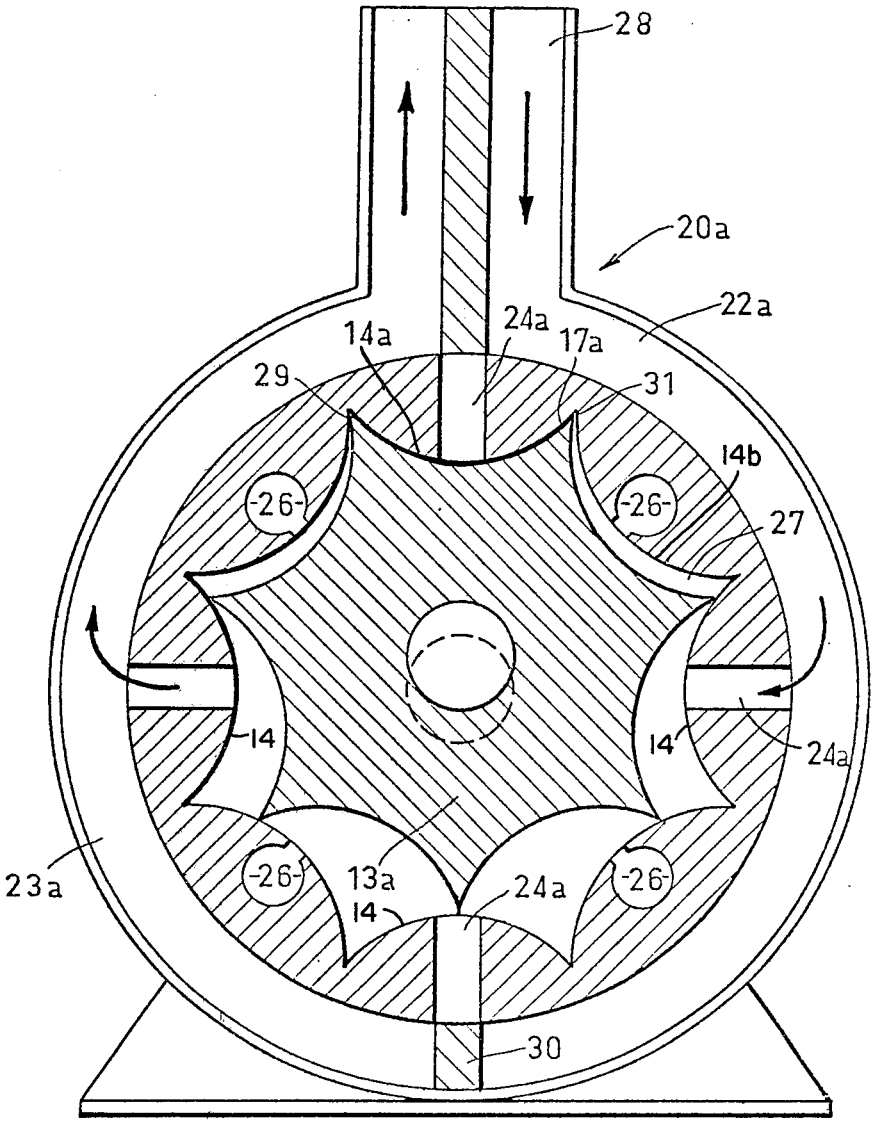
FIG. 2 is an illustration of an embodiment of the invention arranged as an internal combustion engine.

Referring now to FIG. 2, there is shown a simple form of internal combustion engine according to the present invention, which operates on the four-cycle principle. In this embodiment the transfer ports **24*a* are provided through the housing only at every other ridge portion 14 and combustion chambers 26** are substituted for the intermediate ports of the previous embodiment as shown.

For illustrative purposes, reference will now be given to the co-operation of the rotors during two complete revolutions of the inner rotor **13*a*. Assuming clockwise rotation, the uppermost flute 17*a* of the inner rotor 13*a* will coincide with the instantaneous positions of the remaining six recesses as illustrated. As the recess 17*a* moves clockwise to the first position, the leading projection 31 will begin to sweep across the lead of the adjacent ridge portion 14*b* and the trailing projection 29 will sweep across the ridge portion 14*a* with which the flute 17*a* coincided at the top dead centre so that an expanding chamber 27 is formed, and at this stage the passage 24*a* due to a corresponding rotation of the housing will still be communicating with the chamber 27 and with the inlet manifold 22*a*. Thus fuel-air mixture supplied by a carburetor or the like through passage 28 will be admitted into the expanding chamber 27. This process continues through 180° of rotation as the chamber 27 expands, whereafter the trailing projection 29 will sweep across the inlet port 24*a* which in turn will move past the dividing partition seal 30 which divides the inlet manifold 22*a* from the exhaust manifold 23*a***.

At the same time the leading projection 31 will have moved past the opening to the adjacent combustion chamber 26 so that the contents of the chamber 27 are in communication therewith. Further rotation will compress the fuel-air mixture in the combustion chamber until top dead centre and maximum compression is reached and where the compressed mixture is ignited. Further rotation through another one hundred and eighty degrees will be as described above except that the chamber being considered will be communicating with a combustion chamber 26 and not with a port **24*a* as for the first half of the previous revolution. The transfer described at the end of the first one hundred and eighty degress of rotation between the chamber 27 communicating with the combustion chamber 26 instead of the port 24*a* will be reversed and will be a transfer between the combustion chamber and the transfer port which will then coincide with the exhaust manifold 23*a*** to enable discharge of the combusted gases. The expansion during the first one hundred and eighty degrees will of course be the power cycle. Thus a chamber is formed between each adjacent pair of projections, which chamber positively increases and decreases in volume during one revolution of the rotor and during which one induction and compression cycle is provided and ignition is achieved whereafter upon a further revolution of the rotor, the expansion and compression provide the power and exhaust cycle. Thus a four-cycle arrangement is provided, with all the aforementioned advantages. In this embodiment for every two complete revolutions of the rotor seven power cycles are provided. Therefore, in effect, this embodiment provides the equivalent of a seven cylinder four cycle engine with the advantage of having only two moving parts.

Figure 3:
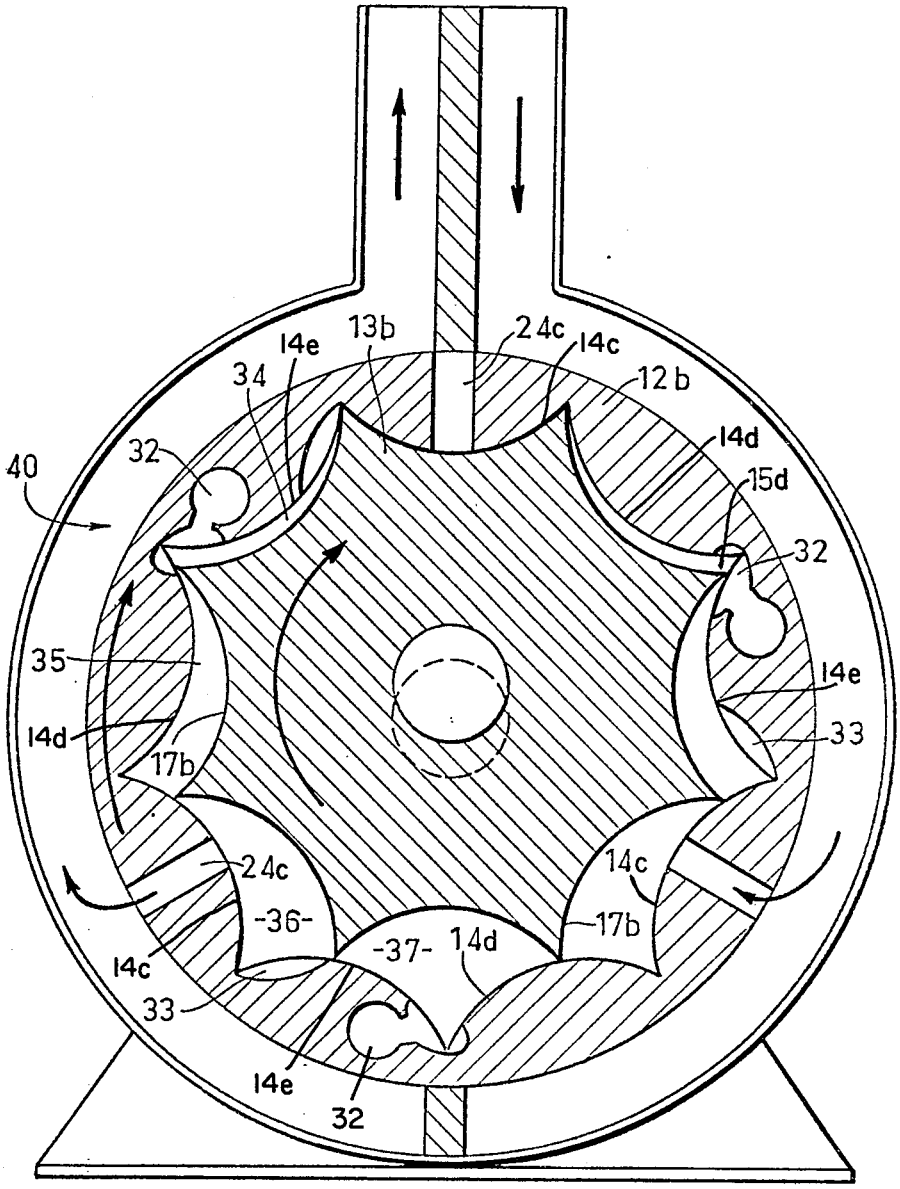
FIG. 3 is yet another embodiment of an internal combustion engine according to the invention.

FIG. 3 illustrates a modified embodiment. The arrangement of the internal cmbustion engine illustrated in FIG. 3 is such that the volume of expansion is increased to approximately twice the volume of compression so that more useful work can be gained from the combusted gases. As illustrated, the inner rotor **13*b* has eight flutes 17*b* and the outer rotor 12*b* has nine ridge portions, the nine ridge portions being necessary because of the double expansion characteristics of this particular embodiment. The nine ridge portions are divided into three sets of three identical segments each segment containing a trailing ridge portion 14*c* having a transfer port 24*c* therethrough, an intermediate ridge portion 14*d* having a common chamber 32 around the leading depression 15*d* extending into the trailing portion of the leading ridge portion 14*e* which also has a cutout 33 therein and in the leading face of each respective third ridge portion 14*e***.

In operation, compressed gas in the chamber 35 is transferred, as the apex passes the trailing edge of the common chamber 32 through the latter into the chamber 34. Thus the compressed gases are dispersed into both chambers—a leading chamber 34 and a trailing chamber 35 which are then in their compressed condition. The mixture is ignited in the common chamber 32 and after expansion in both leading and trailing chambers. The leading chamber, previously in position 34 rotates to position 36. This chamber is in communication with the transfer port 24*c* so that the expanded gases may escape whereafter further rotation will allow the gas in the trailing chamber 35 and now positioned at 37 to transfer the more fully expanded gas through cutout 33 into the leading chamber 36 and out through the exhaust port 24*c*, via chamber 36. Thus the volume available for expansion is approximately twice that of compression enabling the gases to expand down to a very low pressure so that maximum work can be extracted therefrom.

Figure 4:
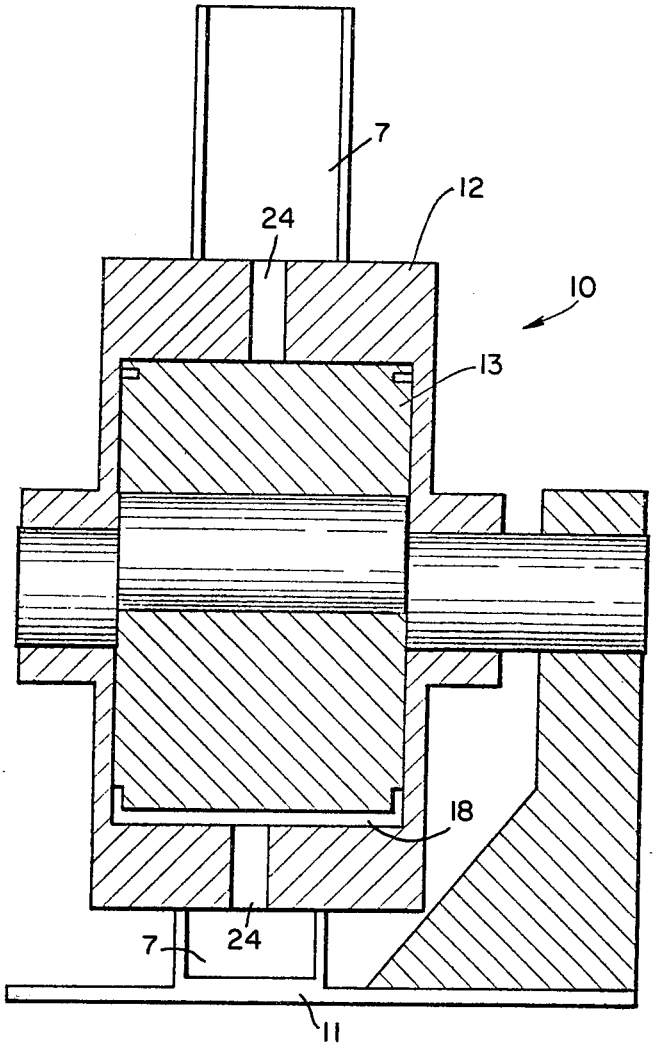
FIG. 4 is a diagrammatic cross-section of the embodiment of FIG. 1 illustrating the offset axes.

FIG. 4 is a diagrammatic cross-section of the embodiment of FIG. 1 showing the offset arrangement of the axils of the respective rotors and it will be appreciated from the above that both rotors in the embodiments described so far are arranged for rotation only. Of course, the outer rotor can be maintained stationary and the inner rotor mounted on a crank shaft for rotation thereabout.

Figure 5:
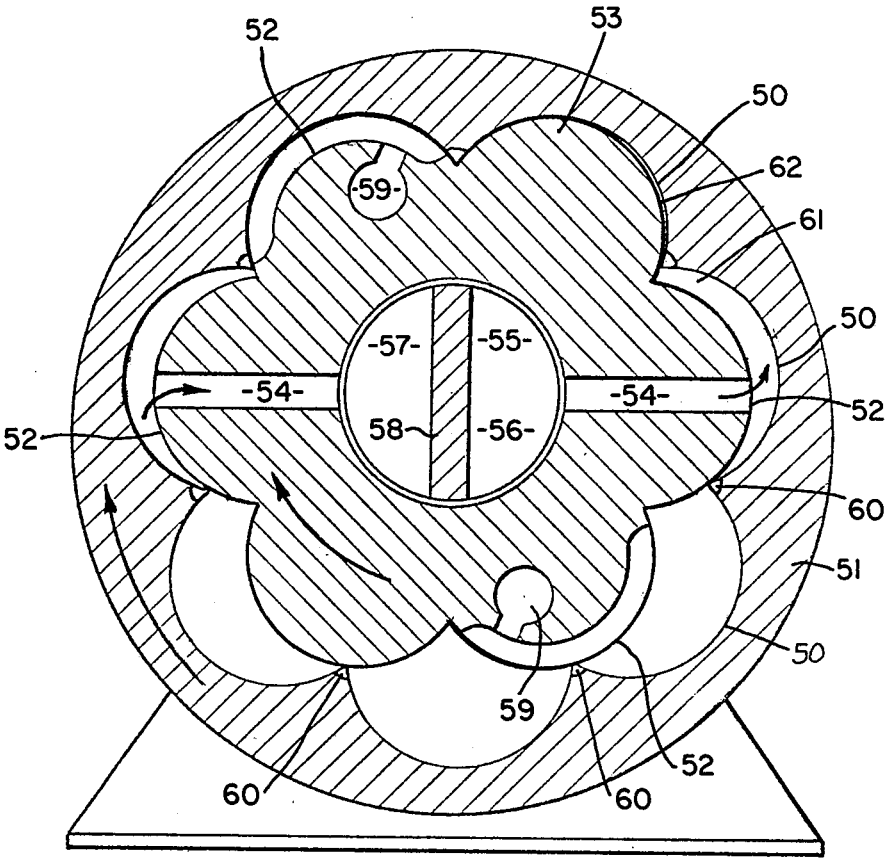
FIG. 5 is a diagrammatic illustration of yet another embodiment of the invention.
Figure 6:
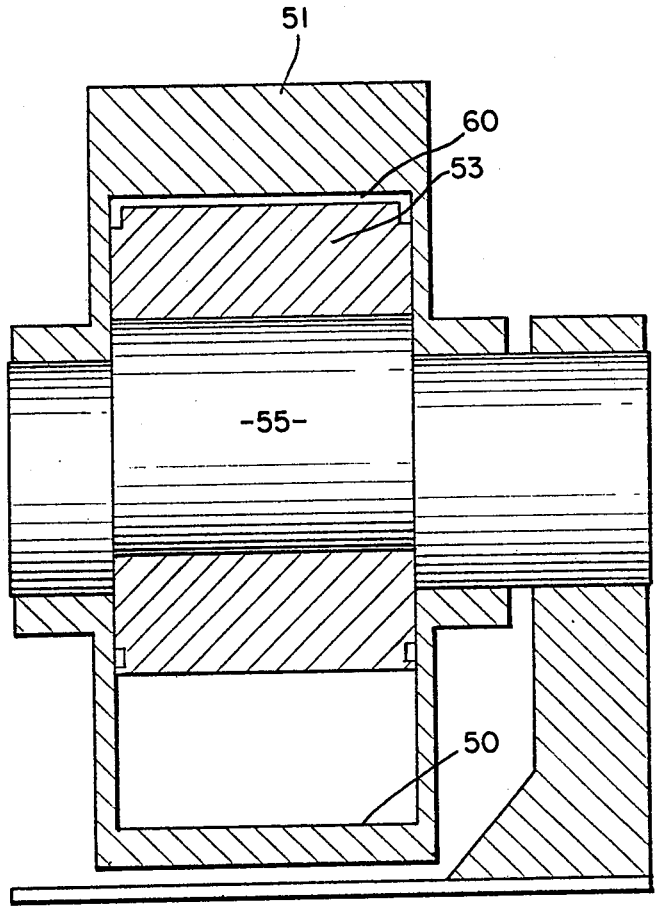
FIG. 6 is a diagrammatic cross-section of FIG. 5.

In FIG. 5 and FIG. 6, an alternate arrangement is shown in which the recesses or flutes 50 are arranged in the outer rotor 51 and the ridge portions 52 are arranged in the inner rotor 53. The arrangement of this embodiment is the inverse to the internal combustion engine illustrated in FIG. 3. The transfer ports 54 extend inwards through the inner rotor 53 to a hollow bore 55 which is divided into two chambers, an inlet chamber 56 and an outlet chamber 57 by a fixed divider 58. This embodiment also features the expansion, after ignition, into double chambers for efficiency and thus the ridges 53 are equal in number to a multiple of three to provide a chamber for induction and compression and two chambers for expansion of the combusted gases. Furthermore, in the induction compression cycle, gas is inducted into a leading chamber 61 through the transfer ports 54 from the inlet chamber 56 and transferred to the adjacent trailing chamber 62 for compression and thereafter into the following chamber as well for expansion into the intermediate and trailing chambers. The respective chambers are sealed by tip-seals 60 in the apex portions of the outer rotor 51.

After expansion, the gas is exhausted through the port 54 to the exhaust chamber 57. Spark plugs (not shown) may be secured in the threaded recesses 59 in the inner rotor. Each recess 59 communicates with a ridge portion 52 as shown, and as the plugs rotate with the housing, they pass through a spark zone at which spark is fed to each plug in turn. Thismay be in the form of a brush or the spark may jump across a gap to the plug. Thus no distributor would be required and once the ignition timing was set, all chambers would fire accurately at the selected degree of advance or retard.

The apparatus according to the present invention could also be arranged to operate as a two-cycle type engine, in which case an external compressor would be provided to fill the chamber with fuel-air mixture after the exhaust gases had been discharged.

However, while the above examples have been given by way of illustrative example, it will of course be realised that many modifications of constructional detail and design may be made to the illustrated invention by persons skilled in the art without departing from the broad scope and ambit of the invention as is set forth in the appended claims.

I claim:

1. An internal combustion engine of the rotary piston type comprising an inner and outer rotor, provided with spaced longitudinal ridges in the outer rotor and substantially conforming flutes in the inner rotor, said flutes extending between longitudinal apices portions spaced evenly around said inner rotor and adapted for engagement between the longitudinally extending valleys formed in said outer rotor at the junction of said ridges, and the diameter of the base circle coincident with the base of said valleys and the diameter of the tip circle coincident with said apices being in the ratio of the respective number of ridges and flutes, there being one more ridge in said outer rotor than the number of flutes in said inner rotor, and the axes of rotation of the respective rotors being offset a distance substantially equal to the differences of the radii of the base circle diameter and the tip circle diameter whereby rotation of one said rotor will cause rotation of the other said rotor, and the depth of each respective ridge from said base circle being substantially equal to the difference between the diameter of said base circle and the diameter of said tip circle, said ridges being arcuate in cross-section such that each said apex remains in contact with a said ridge during rotation of said rotors, said outer rotor having a cylindrical outer surface and there being provided fixed wiping seals adapted to bear against said outer surface of the outer rotor in the respective zones on said outer surface through which the plane passing through said axes pass forming chambers at opposite sides of seals and constituting inlet and outlet chambers respectively and said outer rotor being provided with ridges equal in number to a multiple of three and each group of three ridges comprising a trailing ridge provided with a port communicating with said outer surface, an intermediate ridge and a leading ridge and there being provided a combustion chamber communicating with the valley between said leading ridge and said intermediate ridge and a transfer port in the leading face of said leading ridge.

2. An internal combustion engine of the rotary piston type comprising an inner and outer rotor provided with spaced longitudinal ridges in the inner rotor and substantially conforming flutes in the outer rotor, said flutes extending between longitudinal apices portions spaced evenly around said outer rotor and adapted for engagement between the longitudinally extending valleys formed in said inner rotor at the junction of said ridges, and the diameter of the base circle coincident with the base of said valleys and the diameter of the tip circle coincident with said apices being in the ratio of the respective number of ridges and flutes, there being one more flute in said outer rotor than the number of ridges in said inner rotor, and the axes of rotation of the respective rotors being offset a distance substantially equal to the differences of the radii of the base circle diameter and the tip circle diameter whereby rotation of one said rotor will cause rotation of the other said rotor, and the depth of each respective ridge from said base circle being substantially equal to the difference between the diameter of said base circle and the diameter of said tip circle, said ridges being arcuate in cross-section such that each said apex remains in contact with a said ridge during rotation of said rotors, said inner rotor having a cylindrical inner bore and there being provided fixed wiping seals adapted to bear against said bore in respective zones on said bore through which the plane passing through said axes pass forming chambers at opposite sides of said seals and constituting inlet and outlet chambers respectively and said inner rotor being provided with ridges equal in number to a multiple of three, each group of three ridges comprising a leading ridge provided with a port communicating with said bore, an intermediate ridge and a trailing ridge and there being provided a combustion chamber in said inner rotor and communicating with the valley between said trailing edge and said intermediate ridge.

* * * * *